US010337823B2

(12) United States Patent
Malheiros

(10) Patent No.: US 10,337,823 B2
(45) Date of Patent: Jul. 2, 2019

(54) BREAK BARREL AIRGUN HAVING ACTIVE INTERLOCK

(71) Applicant: Crosman Corporation, Bloomfield, NY (US)

(72) Inventor: George Wallace Rodrigues Malheiros, Victor, NY (US)

(73) Assignee: Crosman Corporation, Bloomfield, NY (US)

( * ) Notice: Subject to any disclaimer, the term of this patent is extended or adjusted under 35 U.S.C. 154(b) by 0 days.

(21) Appl. No.: 15/655,419

(22) Filed: Jul. 20, 2017

(65) Prior Publication Data

US 2018/0031349 A1 Feb. 1, 2018

Related U.S. Application Data

(60) Provisional application No. 62/367,274, filed on Jul. 27, 2016.

(51) Int. Cl.
*F41B 11/648* (2013.01)

(52) U.S. Cl.
CPC ..... *F41B 11/648* (2013.01)

(58) Field of Classification Search
CPC .... F41A 3/58; F41A 11/04; F41A 5/32; F41B 11/648
USPC ..... 124/66, 71–77; 42/8, 26, 40
See application file for complete search history.

(56) References Cited

U.S. PATENT DOCUMENTS 391,953 A 10/1888 Field et al.
3,908,626 A * 9/1975 Hammond ..... F41B 11/648 124/40
3,913,554 A * 10/1975 Pitcher ..... F41B 11/51 124/44.6
3,996,684 A 12/1976 Bauman et al.
4,002,156 A * 1/1977 Fischer ..... F41B 11/51 124/67
4,422,433 A * 12/1983 Milliman ..... F41B 11/54 124/44.7
4,883,042 A 11/1989 Wackrow
5,160,795 A * 11/1992 Milliman ..... F41A 19/53 124/48
5,193,517 A 3/1993 Taylor et al.
5,570,676 A * 11/1996 Gore ..... F41B 11/642 124/56
5,632,264 A 5/1997 Barker et al.
6,539,659 B2 4/2003 Casas Salva
8,375,930 B2 2/2013 Gore
8,714,144 B2 5/2014 Zadra
(Continued)

FOREIGN PATENT DOCUMENTS

DE 102009012771 B3 7/2010

OTHER PUBLICATIONS

U.S. Patent and Trademark Office (ISA/US) International Search Report and Written Opinion from International Appl. No. PCT/US2017/043107, as completed on Sep. 13, 2017.

*Primary Examiner* — Jonathan C Weber
(74) *Attorney, Agent, or Firm* — Brian B. Shaw, Esq.; Harter Secrest & Emery LLP

(57) ABSTRACT

An active interlock for a break barrel airgun includes exposing at least one of a detent pin and a securing pin to a portion of the motive gas for projecting a projectile, wherein the portion of the motive gas urges the one of a detent pin and a securing pin to a locking position inhibiting rotation of a receiver and a barrel of the airgun.

9 Claims, 17 Drawing Sheets

(56) References Cited

U.S. PATENT DOCUMENTS

| | | | | |
|---|---|---|---|---|
| 8,863,421 | B1 * | 10/2014 | Farage | F42B 5/182<br>102/431 |
| 8,915,006 | B2 | 12/2014 | Torre et al. | |
| 9,194,639 | B1 | 11/2015 | Malheiros et al. | |
| 2003/0094167 | A1 * | 5/2003 | Nibecker, Jr. | F41B 11/683<br>124/64 |
| 2015/0065005 | A1 | 3/2015 | Zimmerman et al. | |

* cited by examiner

BREAK BARREL AIRGUN HAVING ACTIVE INTERLOCK

STATEMENT REGARDING FEDERALLY SPONSORED RESEARCH OR DEVELOPMENT

Not applicable.

REFERENCE TO A "SEQUENCE LISTING"

Not applicable.

BACKGROUND OF THE INVENTION

Field of the Invention

The present disclosure relates to airguns and particularly to a break barrel airgun with an active interlock between a barrel assembly and a receiver, wherein a motive gas biases the active interlock to a locking position.

Description of Related Art

U.S. Pat. No. 8,915,006, herein expressly incorporated by reference, discloses a sporting rifle with a firing mechanism, comprising a chamber joined to a fork, a barrel, a butt and means of fixing the butt to the fork, wherein the fork comprises at least one projecting stop secured to the outside of the fork which, when the fork is positioned on the butt, the at least one stop is fitted into a corresponding housing located on the butt and the at least one stop is positioned on the fork with the weld located between the stop and the chamber.

U.S. Pat. No. 6,539,659, herein expressly incorporated by reference, discloses a barrel box integral with the barrel rear end, with a hinge and latch for closing with respect to a fork integral with the front end of a pressure chamber. The barrel box being connected to a mechanism of levers for compressing a plunger of the pressure chamber, the fork including an internal fork part obtained by molding, which concentrates most of the complex configurations, tightly fit and joined to a portion of a the mouth of the pressure chamber, which is of metal tube and tightly covers the whole of the internal fork part, the barrel box being also obtained by molding, with a rear part of the barrel as an insert.

U.S. Pat. No. 5,632,264, herein expressly incorporated by reference, discloses a gun with a pivoting barrel includes a compression tube having a forked front end and a fork member which is inserted into the front end of the compression tube. The fork member includes a cylindrical body which is inserted into the compression tube and a pair of forked arms which extend along the inside of the forked end of the compression tube. A barrel is pivotably connected to the forked ends of the fork member and the compression tube. A spring clip on the barrel engages a stud on the fork member for releasably retaining the barrel in a firing position. A cocking lever connected to the barrel is engageable with a trigger extension for preventing the trigger from being pulled when the barrel is not in the firing position.

However, the remains for an active interlock for interlocking the barrel relative to the receiver in a break barrel airgun during the firing of the airgun.

BRIEF SUMMARY OF THE INVENTION

The present disclosure provides an airgun having a barrel assembly; a receiver pivotally connected to the barrel assembly between a firing position and open position; a pressure generator selectively providing a volume of pressurized gas; and an active interlock moveable between (i) a retracted position allowing movement of the barrel assembly and the receiver from the firing position to the open position and (ii) an extended position upon the barrel assembly and the receiver being in the firing position, wherein the active interlock is fluidly connected to the volume of pressurized gas which urges the active interlock to the extended position.

In a further configuration, the airgun includes a pressure generator selectively providing a volume of pressurized gas; an active interlock fluidly connected to the volume of pressurized gas and moveable between a first retracted position and a second locking position in response to expose to the volume of pressurized gas; and a barrel pivotally mounted relative to the pressure generator, the barrel having a bore, the barrel moveable between an open position and a firing position, wherein with the barrel in the firing position, the active interlock in the second locking position inhibits rotation of the barrel relative to the pressure generator.

It is further contemplated the airgun can include a barrel; a pressure generator selectively retaining a volume of pressurized gas; and an active interlock fluidly connected to the pressure generator, the active interlock movable between a first retracted position and a second locking position, the active interlock exposed to the volume of pressurized gas in the pressure generator to be disposed in the second locking position.

BRIEF DESCRIPTION OF THE SEVERAL VIEWS OF THE DRAWING(S)

DETAILED DESCRIPTION OF THE INVENTION

Figure 1:
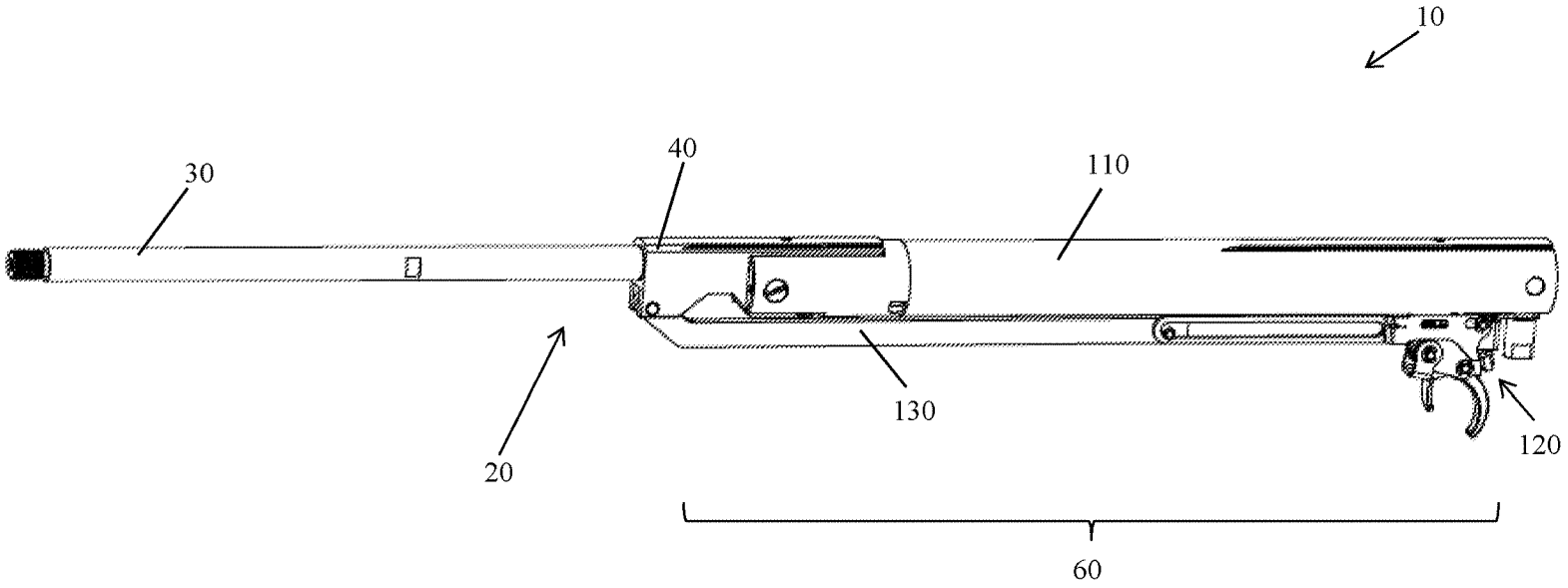
FIG. 1 is a side perspective view of the airgun with the stock and grips removed.
Figure 2:
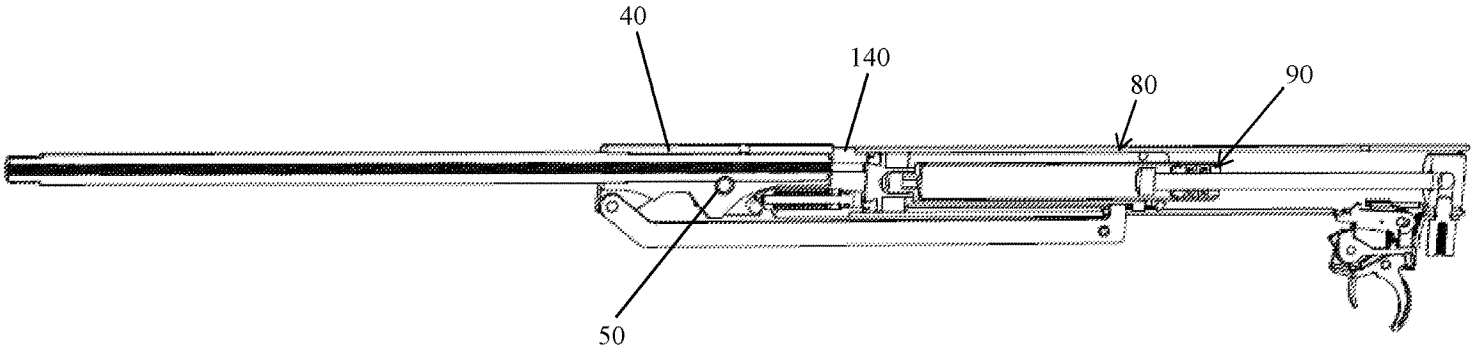
FIG. 2 is a cross sectional view of the airgun of FIG. 1.
Figure 3:
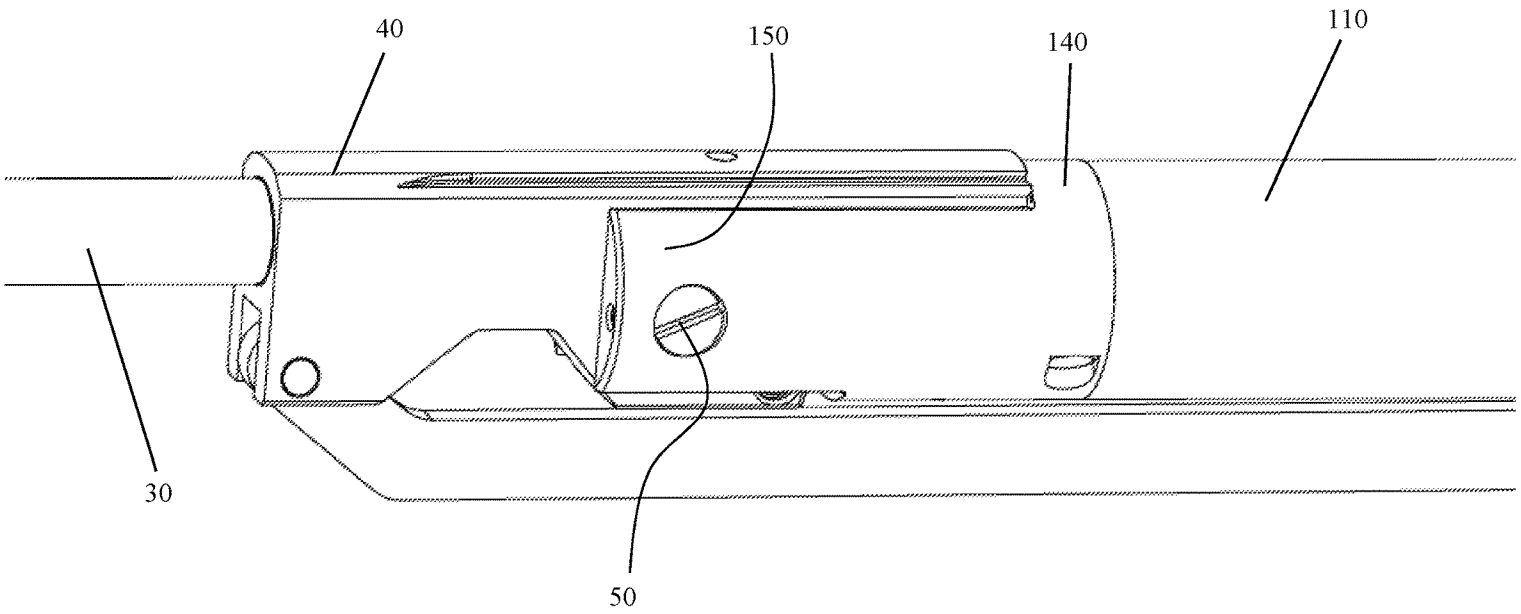
FIG. 3 is an enlarged view of a portion of FIG. 1 showing the breech block, the fork, and a portion of the compression tube.
Figure 4:
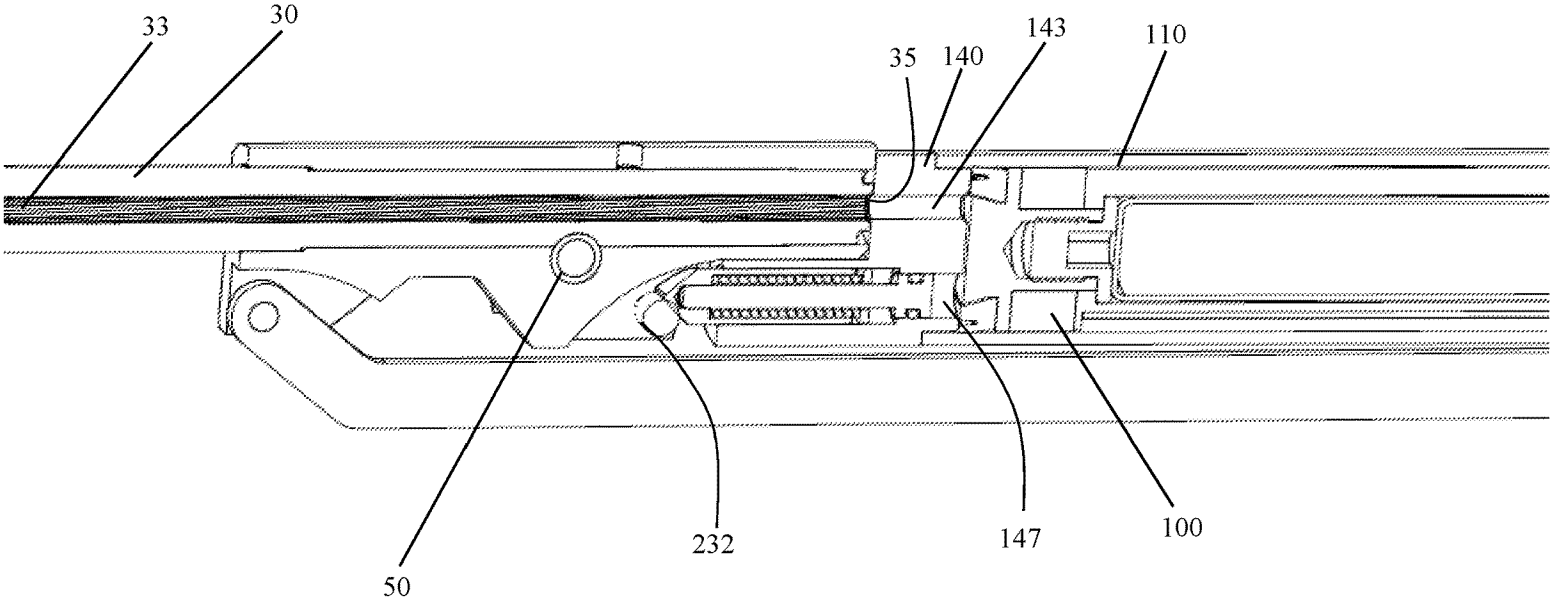
FIG. 4 is a cross sectional view of generally FIG. 3.

Referring to the Figures, the workings of a representative airgun 10 are shown. The term airgun includes, but is not limited to a projectile launching weapon using a compressed gas passing through a hollow, tubular barrel with a closable end for directing a projectile along the barrel to exit along a trajectory.

As seen in the Figures, in one configuration, the airgun 10 is a break barrel airgun (sometimes referred to as a break action rifle or gun). Although, the present configuration is shown as a long barrel or rifle configuration, it is understood the present system can be employed in a pistol.

In the break barrel airgun 10, a barrel assembly 20 is pivotally mounted relative to a receiver 60. The pivotal mounting exposes a breech and creates a lever arm for the user to cock the airgun 10, so as to impart energy to a spring (mechanical or gas) seen in the figures which provides the motive force to propel a projectile. Typically, as the break barrel airgun 10 is moved through a cocking cycle, a linkage having a lever, as known in the art, acts against the spring. A piston driven by the spring is selectively released to release the stored energy to create a compressed or high pressure gas, sometimes referred to as a motive gas, which is exposed to (i) the projectile and as set forth below, (ii) an active interlock, sometimes referred to an interlock, such as at least one of a detent pin and a securing pin.

Referring to the Figures, the airgun 10 includes the barrel assembly 20 and the receiver 60, wherein in one configuration, the barrel assembly generally includes a barrel 30 and a breech block 40 and the receiver 60 is carried by a stock (not shown), and includes a pressure generator 80, a trigger assembly 120 and a cocking mechanism 130, wherein the pressure generator can be configured to include a spring, a compression piston and a compression tube.

In one configuration, the receiver is incorporated with or carried by a main frame (or the stock), wherein the stock can include a grip as well as a foregrip.

The main frame (stock) can be formed of halves or upper and lower portions, as known in the art as well as a substantially one piece molded or wooden construction. The main frame is constructed to retain and operably locate the remaining components. The grip and/or foregrip can be separately constructed or integral with the main frame.

The barrel assembly 20 includes the barrel 30 and the breech block 40. The barrel 30 is an elongate tube having a bore 33 extending along a longitudinal axis, the bore receiving and passing a projectile from a breech 35 adjacent the receiver 60 to a muzzle 37 for passing the projectile from the airgun. The bore 33 is sized for passing a projectile of a predetermined size. Thus, the barrel 30 can be any of a variety of calibers. The barrel 30 extends along the longitudinal axis from the breech 35 to the muzzle 37.

The barrel assembly 20 is pivotally mounted to the receiver 60 and hence the stock by virtue of a pivot pin 50 as set forth below. Typically, the pressure generator 80 moves with the receiver 60 in the rotating or pivoting relationship relative to the barrel 30. The barrel 30 and the receiver 60 are in the operable or firing position when the barrel is aligned with the receiver such that a pressurized gas passes from the pressure generator 80 into the breech 35 of the barrel 30 to propel a projectile along the barrel. The barrel 30 and the receiver 60 are in the open or loading position when the breech 35 of the barrel is exposed or open such as during cocking of the airgun as set forth below.

Generally, an active interlock 200 is carried by one of the barrel assembly 20 and the receiver 60. The active interlock 200 is sometimes referred to as an interlock. The active interlock 200 reacts and moves in response to exposure to the motive gas. The active interlock 200 can include at least one of a detent pin 220 and a securing pin 260.

In the configuration of the active interlock 200 including the detent pin 220, the detent pin is carried by one of the barrel assembly 20 and the receiver 60. A remaining one of the barrel assembly 20 and the receiver 60 includes a capture socket 230 sized to receive a portion of the detent pin 220. The detent pin 220 is moved between a firing or locking position in which a portion of the detent pin is within the capture socket 230 and an opening position wherein the detent pin is withdrawn from the capture socket. As the detent pin 230 is disposed within the capture socket 230, rotation of the barrel assembly relative to the receiver is inhibited, while withdrawal of the detent pin from capture socket allows for rotation of the barrel assembly 20 relative to the receiver (cocking of the airgun).

In certain configurations, a locking pin 232 intersects the capture socket 230 so as to contact the detent pin 220 in the firing or locking position. The locking pin 232 is used to provide a substantially fiducial contact for the detent pin 220, thereby repeatably fixing the position of the barrel assembly 20 relative to the receiver 60 upon engagement of the detent pin and the capture socket 230.

Figure 8:
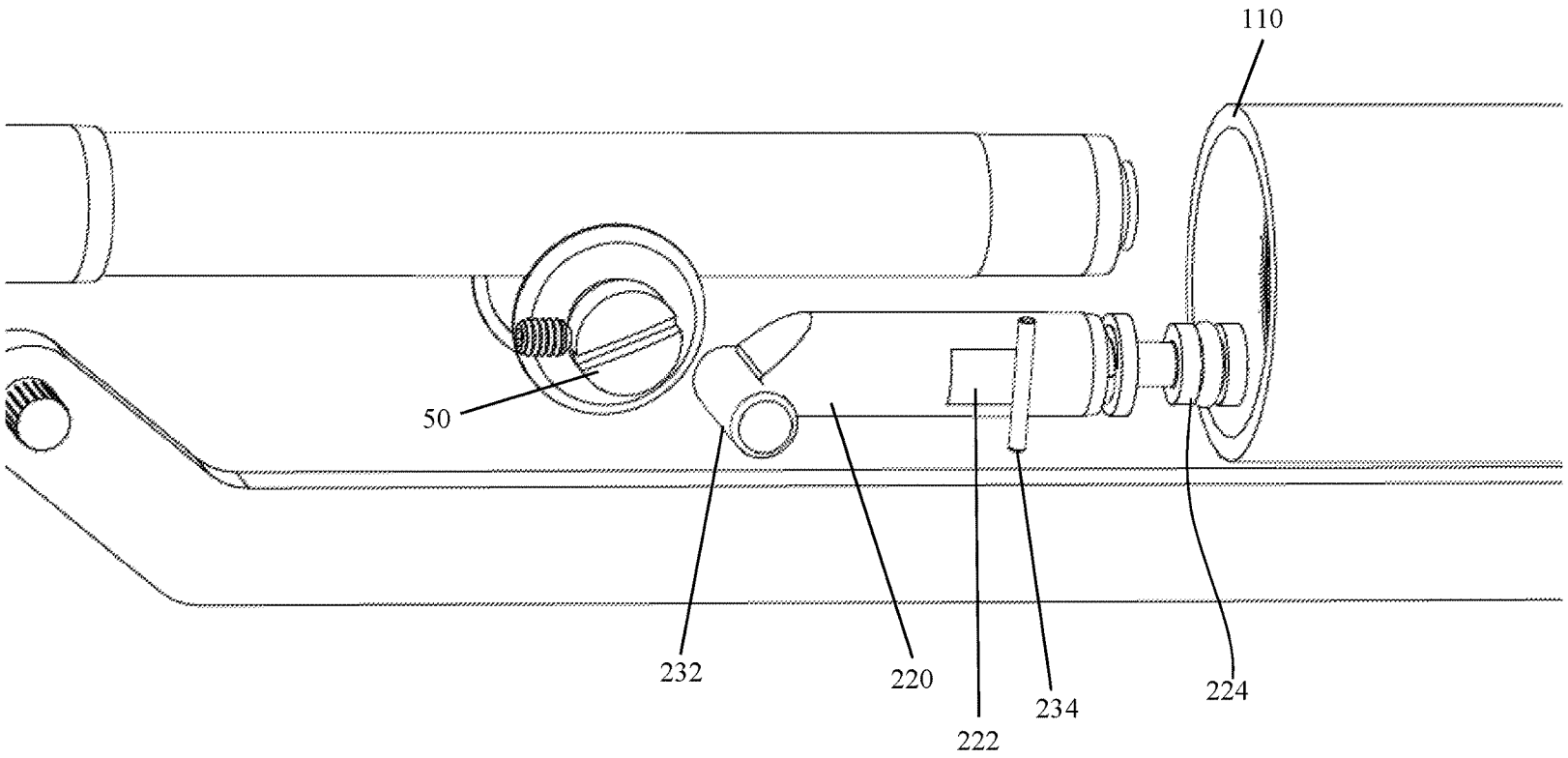
FIG. 8 is a portion of the airgun of FIG. 1, with the breech block and fork removed.
Figure 9:
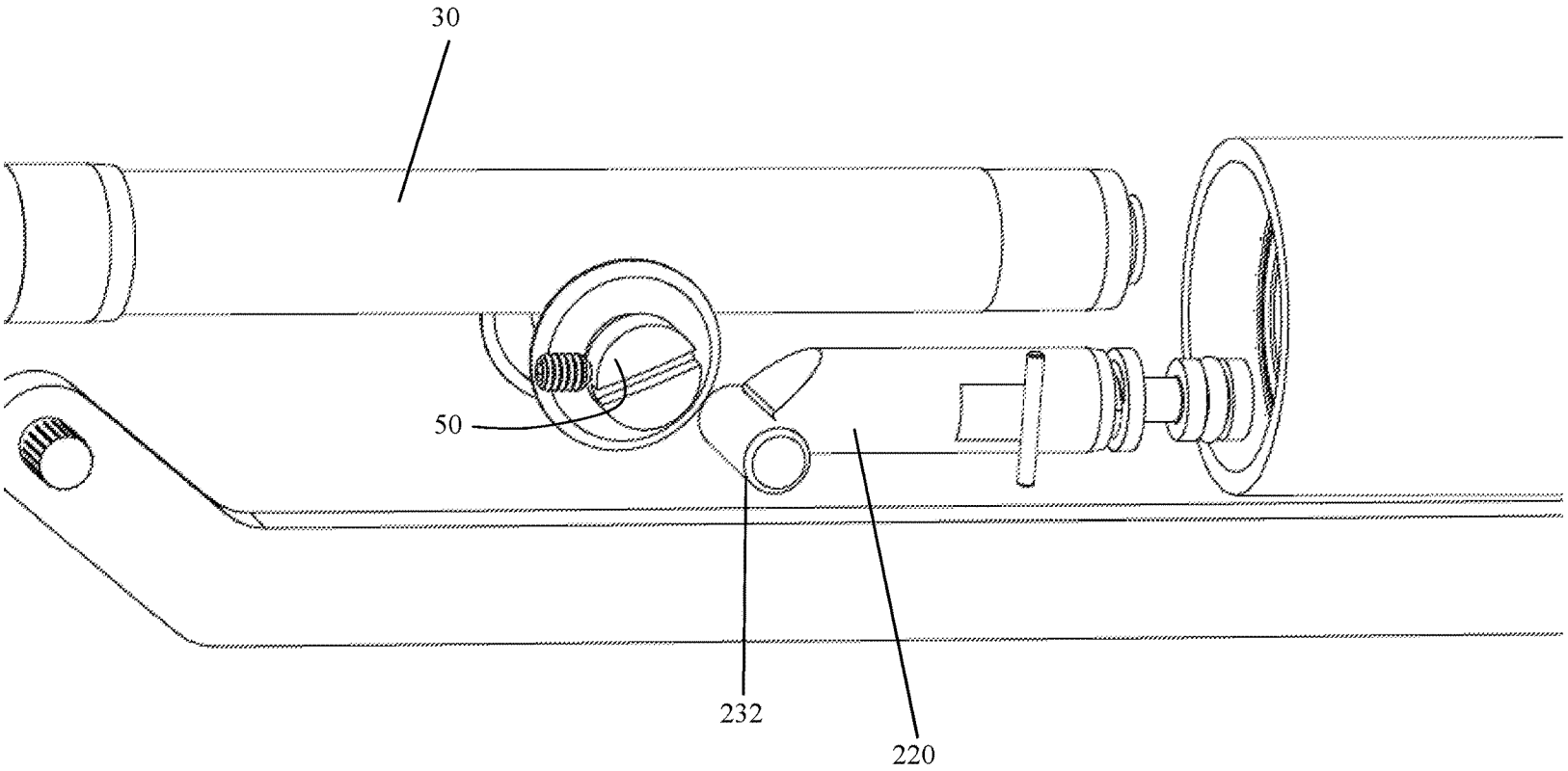
FIG. 9 is an alternative angle view of FIG. 8.
Figure 10:
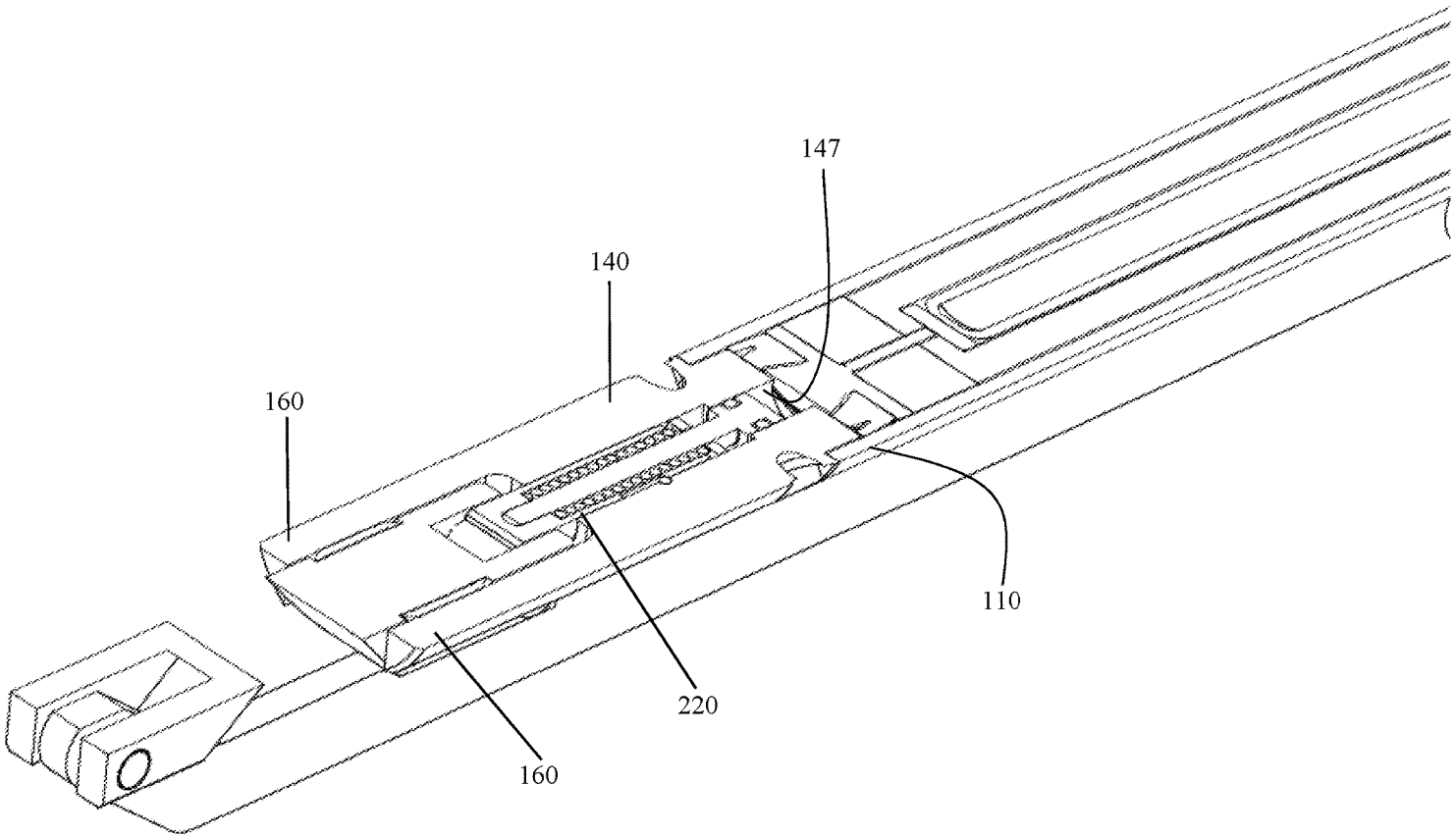
FIG. 10 is a cross sectional view showing a cross section of the detent pin and plunger in the fork and breech block.
Figure 11:
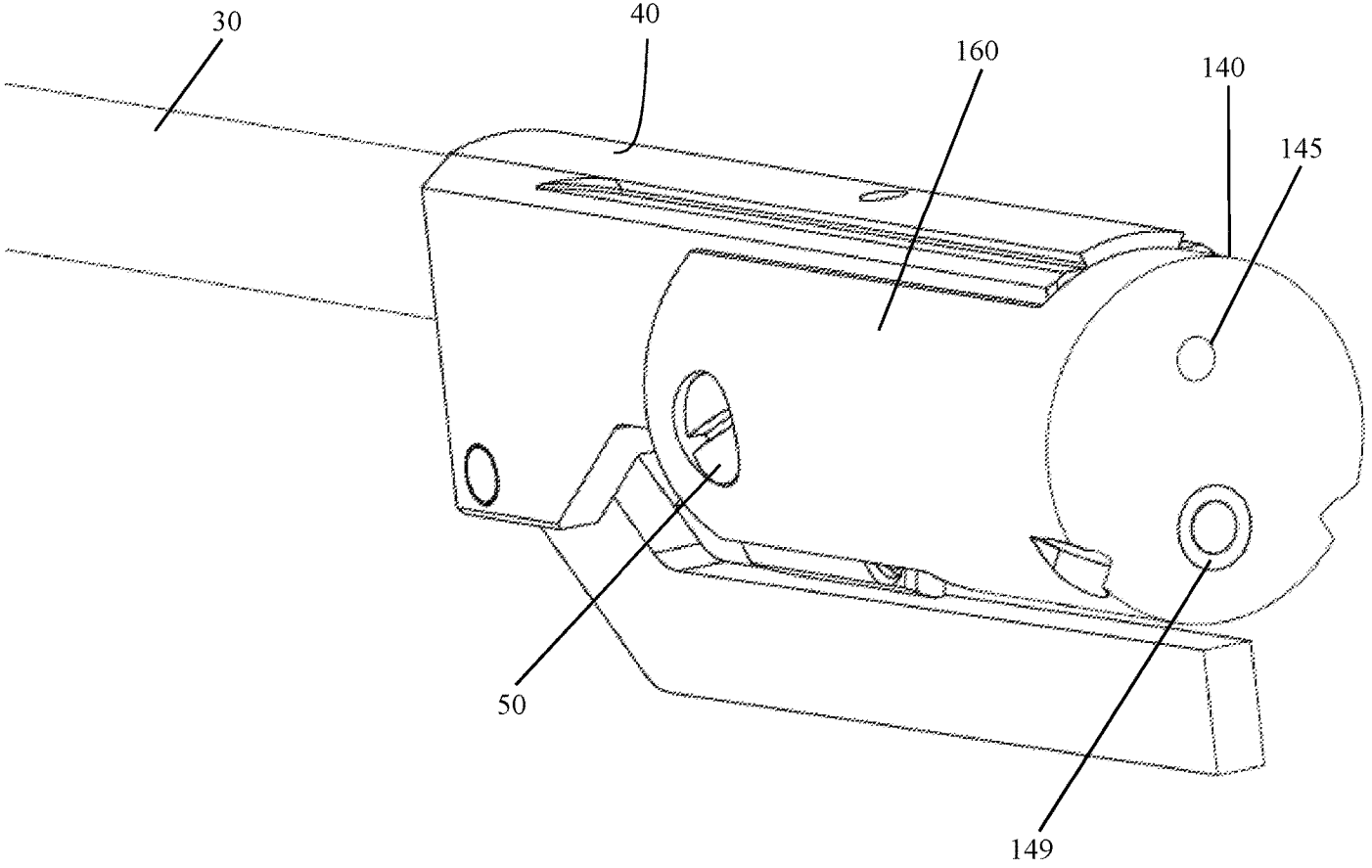
FIG. 11 is a rear perspective view of the barrel, fork and breech block.
Figure 12:
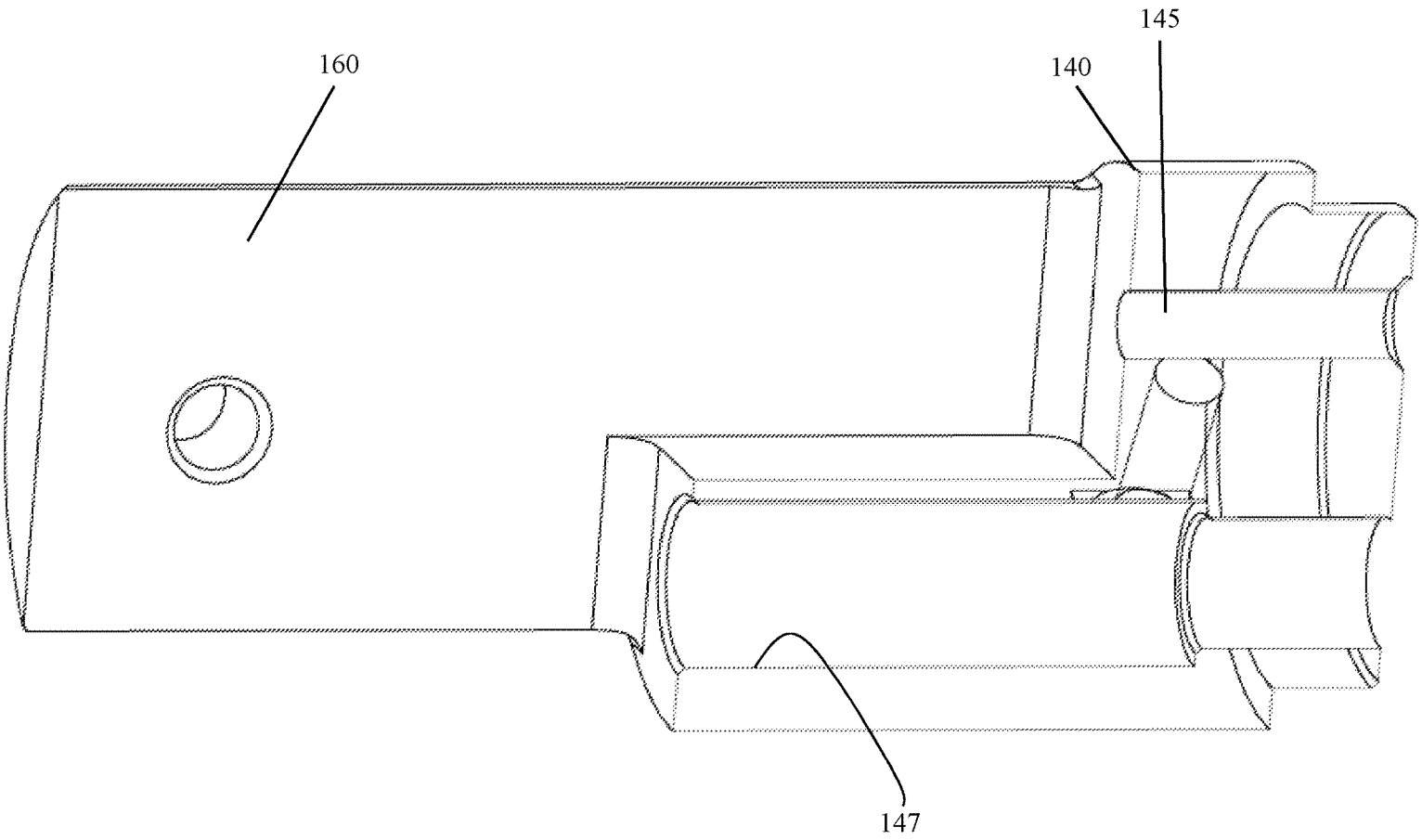
FIG. 12 is a cross sectional view of the fork.

As shown in FIGS. 8 and 9, the detent pin 220 can include a flat or bounded land area 223 for contacting a guide pin 234 in the breech block 40 to assist in locating the detent pin 220 in the locking position.

Figure 13:
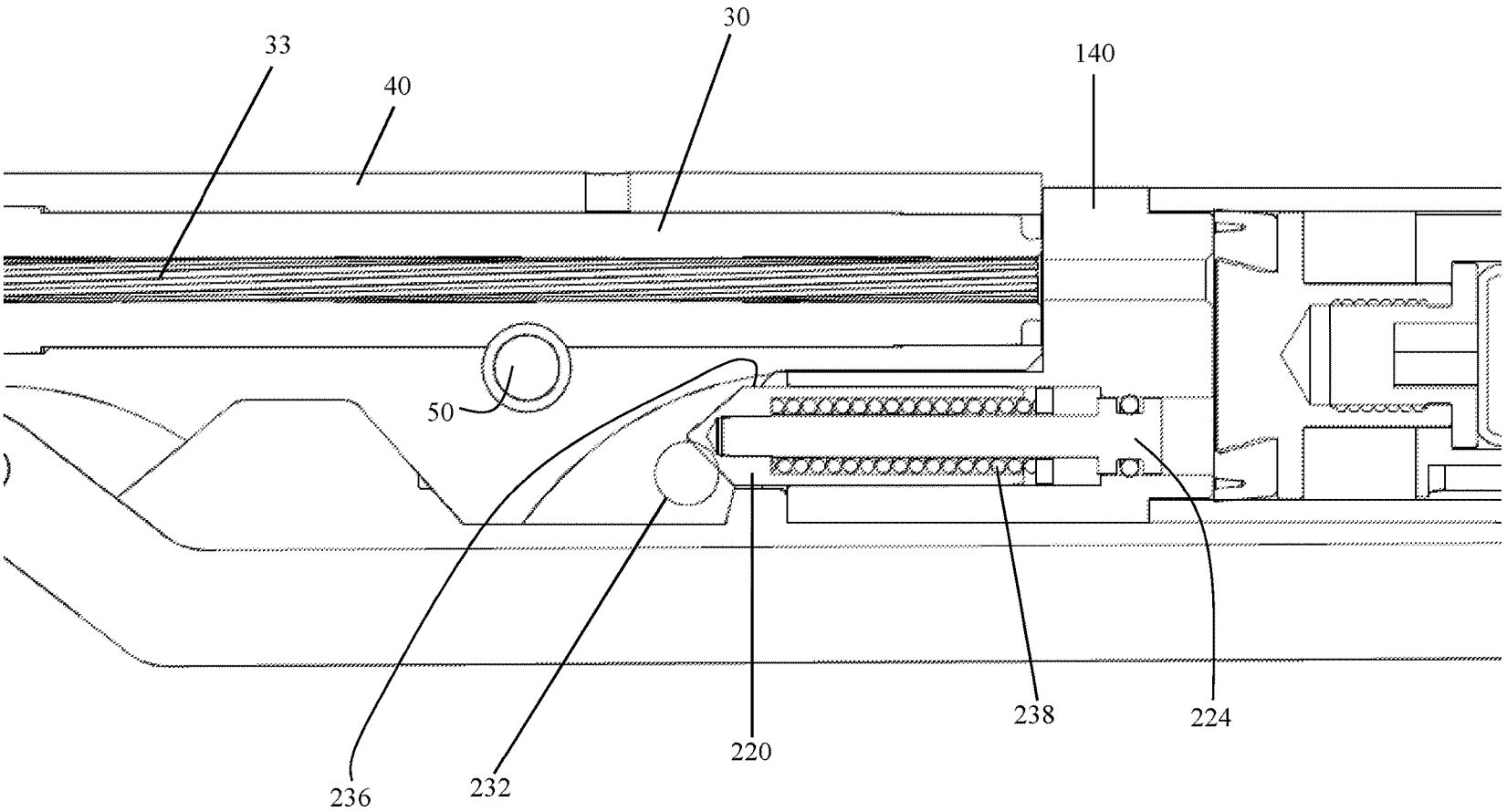
FIG. 13 is a side elevational cross sectional view.
Figure 14:
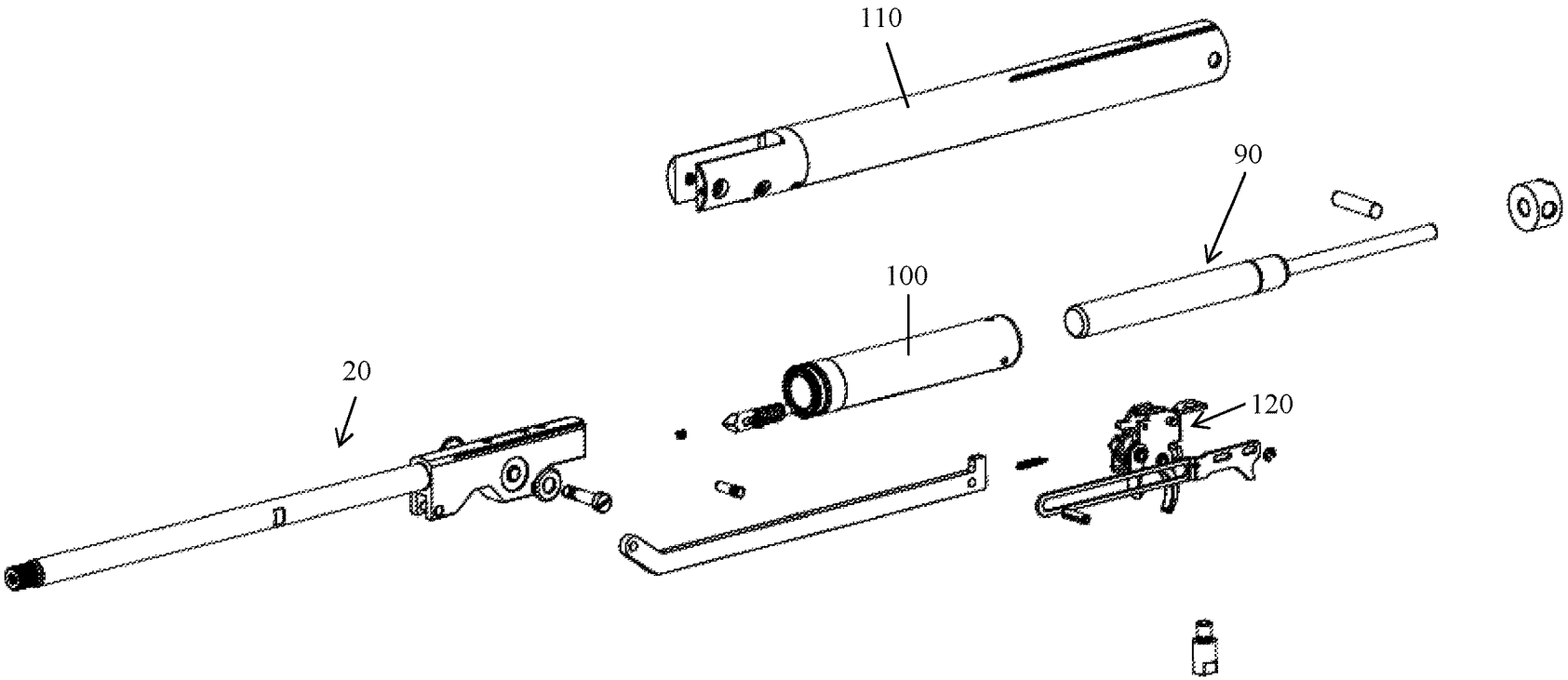
FIG. 14 is an exploded perspective view of another configuration of the airgun having the active interlock.
Figure 15:
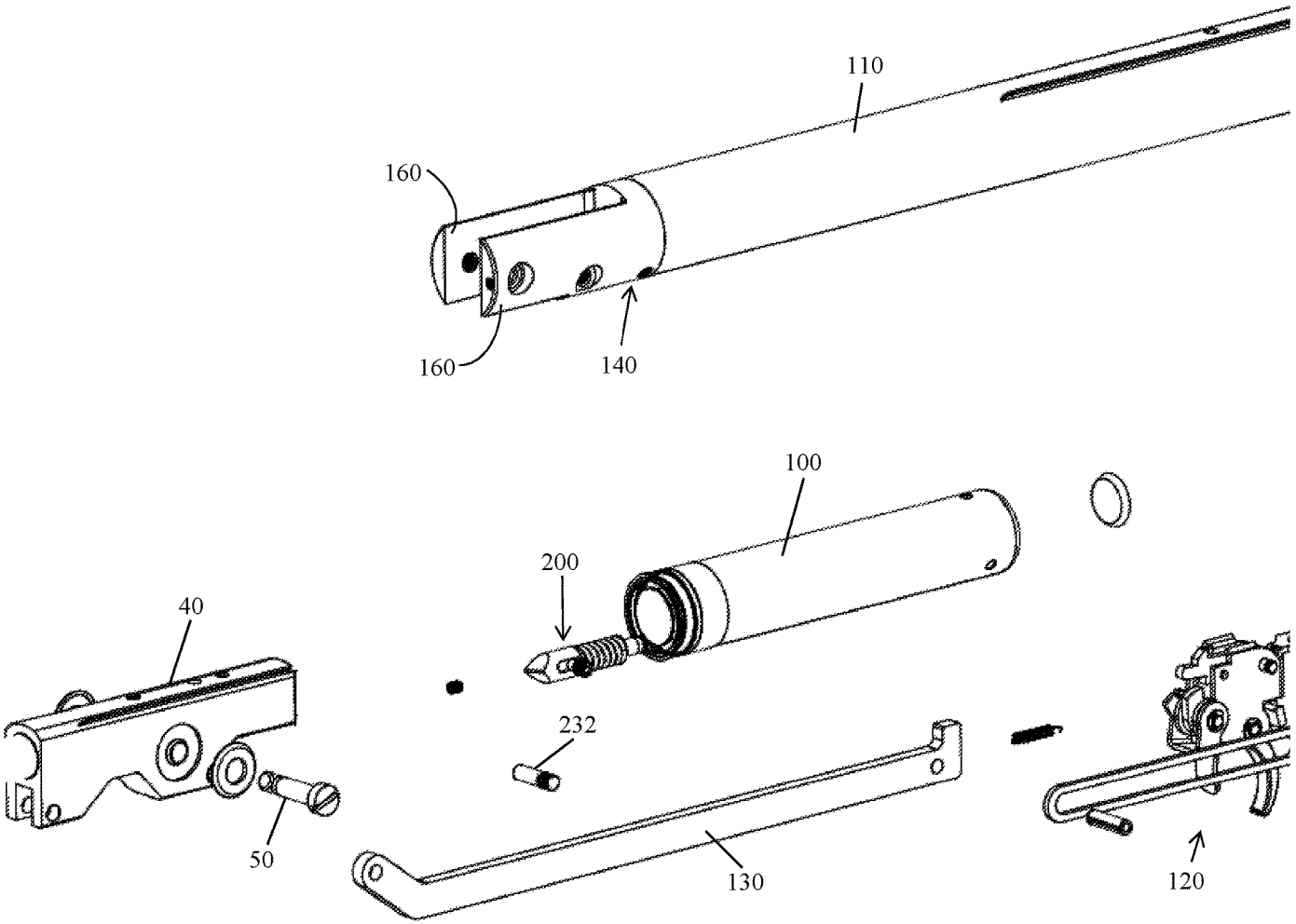
FIG. 15 is an enlarged portion of FIG. 14.

In addition referring to FIG. 13, the capture socket 230 can include a stop surface 236 for contacting the detent pin 220 in the firing (locking) position to limit rotation of the barrel assembly 20 relative to the receiver 60 in one direction, which is typically opposed to the direction of rotation for cocking the airgun 10.

A bias spring 238 can be engaged with the detent pin 220 to urge the detent pin to the locking position. In one configuration, the detent pin 220 includes a main body having an angled or tapered head 222 with intersecting surfaces. Specifically, one of the intersecting surfaces 222 of the detent pin 220 engages the locking pin 232 in the firing position and a portion of the main body (which surface is non-parallel to the intersecting surface) engages a stop surface 240 of the capture socket 230.

Thus, the active interlock 200 can be urged to the locking position by the combination of the bias spring 238 and the exposure to the pressurized gas from the pressure generator 80.

For purposes of description, the barrel assembly 20 includes the breech block 40 and the breech block defines the capture socket 230 with the stop surface 236, the locking pin 232 and the guide pin 234. Although set forth as the locking pin 232 and the guide pin 234, it is understood the pins could be replaced as surfaces of the barrel assembly 20 rather than separate pins.

In addition, the breech block 40 includes the pivot axis for the pivot pin 50 about which the barrel assembly 20 rotates relative to the receiver 60. That is, the pivot pin 50 extends through the breech block 40 as well as a portion of the receiver 60 as set forth below.

In one configuration, the stop surface 236 and the locking pin 232 are located to engage spaced portions of the active interlock 200, such as the detent pin 220.

As seen in the Figures, the pivot pin 50, and a corresponding axis of rotation, are spaced a first perpendicular distance from the longitudinal axis and the engagement of the locking pin 232 and the detent pin 200 is spaced a second greater perpendicular distance from the longitudinal axis. In one configuration, the second distance is greater than the first distance and in a further configuration, the second distance is at least twice the first distance. In one configuration, the second distance is sufficiently greater than the first distance to create a lever arm that results in a rotational force about the pivot pin 50 from the detent pin engaging the locking pin 232 that tends to engage the stop surface 236 with the detent pin 220. That is, upon the detent pin 220 being urged into the capture socket 230 and against the locking pin 232, a portion of this force acts on the lever arm (defined by the spaced pivot pin and locking pin) to create a moment urging the barrel assembly to the firing position.

In one configuration of the present system, the active interlock 200 is provided by the detent pin 220 being directly or indirectly (via a plunger) exposed to the pressure generator 80.

Figure 5:
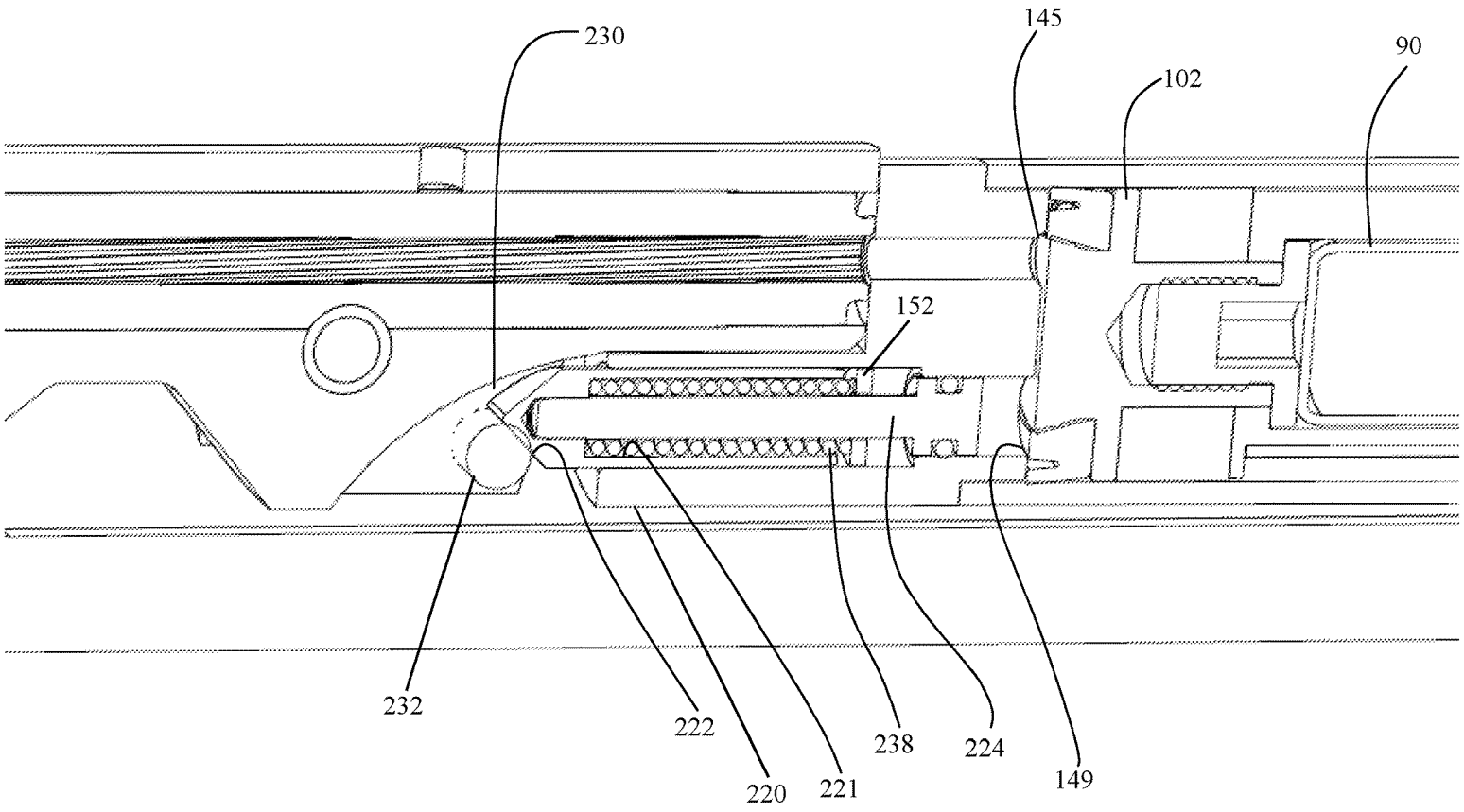
FIG. 5 is an enlarged view of a portion of FIG. 4.
Figure 6:
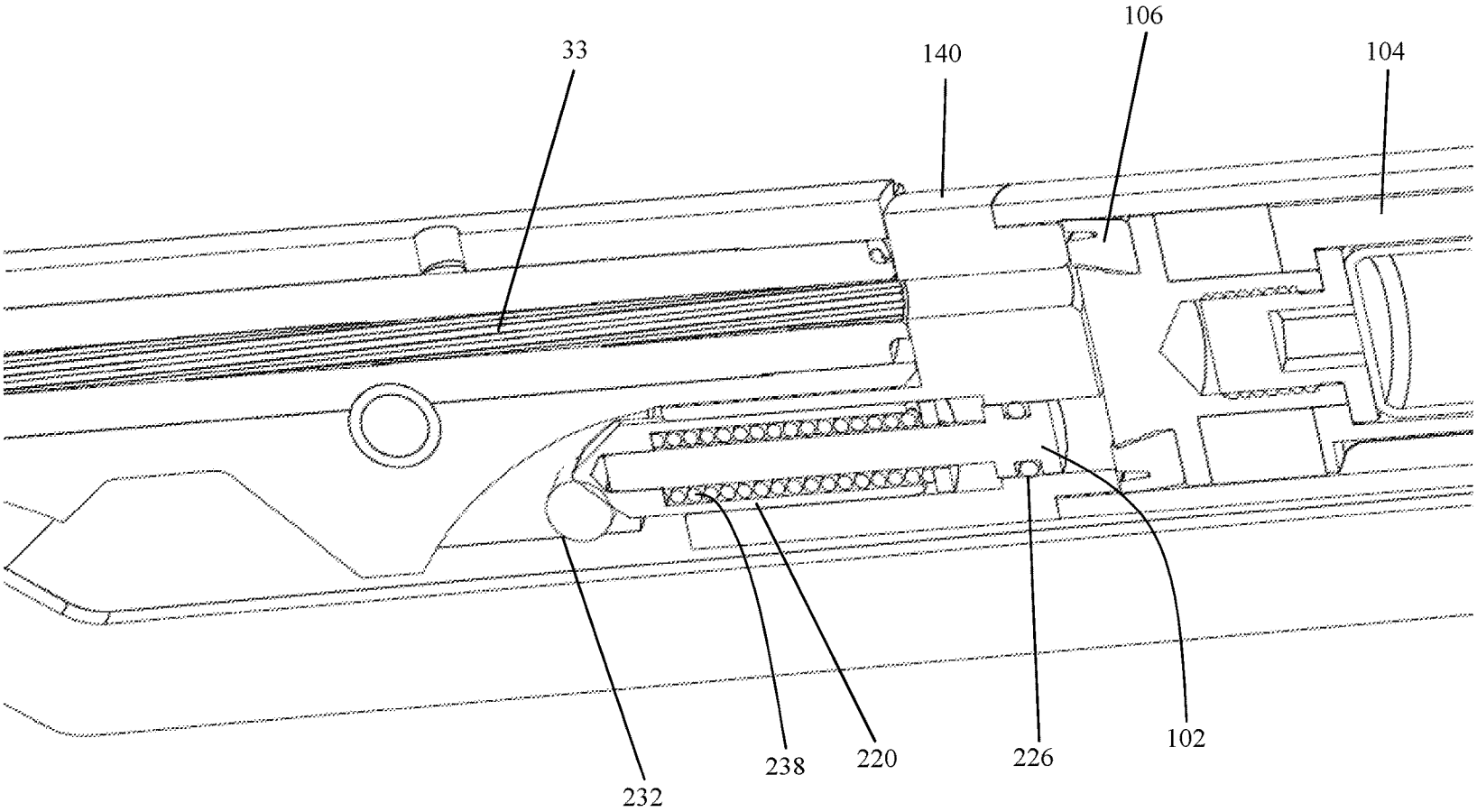
FIG. 6 is substantially the portion of FIG. 5 from a different angle.
Figure 7:
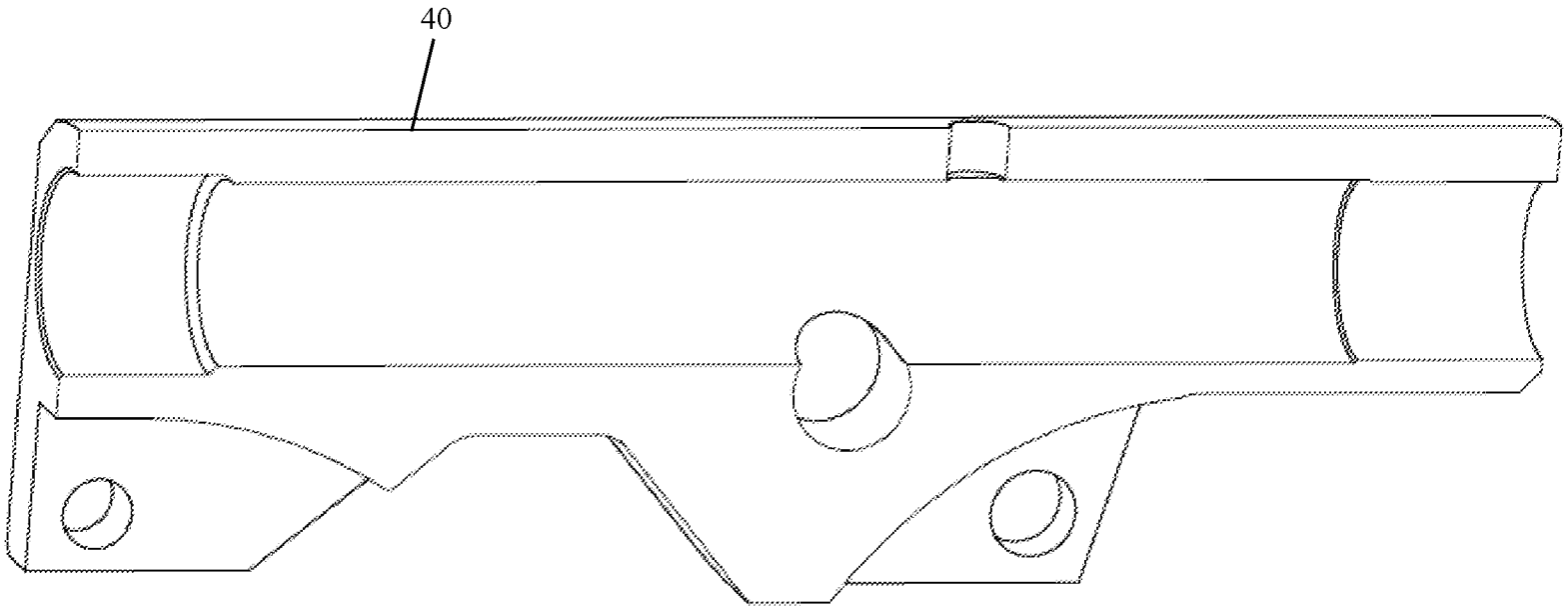
FIG. 7 is a cross sectional view of the breech block.

Referring to FIG. 5, in one configuration, the detent pin 220 includes a plunger 224 that is exposed to the pressure generator 80. A portion of the plunger 224 is exposed to the pressure generator 80. While the pressure generator 80 can be located in either the barrel assembly 20 or the receiver 60, for purposes of description, the pressure generator is shown as disposed in the receiver.

As set forth above, the receiver 60 includes the trigger assembly 120 along with the pressure generator 80, sometimes referred to as a compression assembly.

The pressure generator 80 can be any of a variety of mechanisms for providing a supply of pressurized or relatively high pressure gas to the barrel 30 as a motive gas. For example, the pressure generator 80 can be one of a reservoir retaining a volume of compressed gas, a compressed gas, a fan including a propeller or an impeller as well as a spring actuated piston, wherein the spring can be a metal coil spring or a gas spring as known in the art.

In one configuration, the pressure generator 80 includes the spring 90 driving the compression piston 100 slideably received in the compression tube 110, wherein the spring is cocked by lever action of the break barrel airgun 10 as well known, and the compression piston 100 slides within the compression tube 110 upon actuation by the trigger assembly 120 as well known in the art.

As seen in the Figures, the compression piston 100 is slideably disposed within the compression tube 110, and includes a piston head 102 and a piston body 104. For purposes of description, the piston head 102 is the portion of the compression piston 100 that is forward of the piston body 104. That is, the piston head 102 is nearer to the muzzle (or the motive gas port) than the piston body 104.

Although the piston head 102 and piston body 104 could have numerous constructions, for purposes of the present description, the piston body 104 is a generally cylindrical elongate member and includes an elongate channel for accommodating the cocking mechanism, as known in the art.

The piston head 102 carries a piston seal 106 for forming a sliding sealed interface with the inside surface of the compression tube 110. The piston seal 106 is well known in the art in both material and structure. Similarly, the engagement of the piston seal 106 to the piston head 102 can be provided as known in the art, such as by seal retainer which is in the form of a flared or tapered surface selected to engage a corresponding surface on the seal.

The spring 90 can be any of a variety of configurations including metal coil or helical springs, composite or alloy coil or helical springs as well as a pneumatic or gas springs or struts. Each of these types of springs is well known in the industry. In one configuration, seen in the Figures, the spring 90 is a longitudinal spring that can be longitudinally compressed or extended but returns to a former configuration when released. In an alternative configuration, the spring 90 is a helical metal coil which expands and contracts generally along a longitudinal axis of the spring. Referring to the figures, the spring 90 is a gas spring having a gas spring body defining a sealed interior chamber containing a compressed gas and a gas spring piston extending into and moveable relative to the sealed interior chamber, the interior chamber retaining the compressed gas when the gas spring piston moves. Thus, as the gas spring piston is forced into the sealed interior chamber during cocking, the pressure in the internal chamber rises even further as the piston reduces the effective volume of the interior chamber. The increased pressure thus creates a force on the piston urging the piston from the interior chamber. Thus, the spring can be connected to the compression piston to move the compression piston from a first position in the compression tube to a second position in the compression tube.

As seen in the Figures, a fork 140 can define the exposure of the barrel bore 33 and the detent pin 220 to the pressure generator 80. In one configuration, the fork 140 includes a motive gas passageway 143 defining a motive gas port 145 and a separate locking gas passageway 147 defining a locking gas port 149. The fork 140 can be affixed to or define an end of the compression tube 110 against which the high pressure gas is generated.

The fork 140 can include a pair of spaced opposing blades 160, wherein each blade includes a pivot pin aperture 163, wherein the pivot pin 50 passes through one of the blades, then through the breech block 40 and finally the second blade, thereby defining the rotational axis for rotation of the barrel assembly 20 (and barrel 30) relative to the receiver 60. The blades 160 are separated by a distance to allow rotational movement of the barrel assembly 220 between the blades 160 for movement between a firing position and an open position.

The compression tube 110 is well known in the art and is typically formed of a metal for performance, safety and durability factors. The compression tube 110 includes an inner or inside wall or surface and defines or interfaces with a motive gas port and a locking gas port. The breech (barrel) bore is fluidly connected to the motive gas port.

Although the motive gas port and the locking gas port are shown as independent ports, it is understood only a single one of the ports can be defined at the interface with the interior of the compression tube, wherein the remaining one of the ports extends from the port interfacing with the compression tube.

The plunger 224 of the detent pin 220 is sized to be slideably received within the locking gas passageway 147, wherein a seal 226 such as an O-ring can define a sealed interface between the plunger and the passageway.

Figure 16:
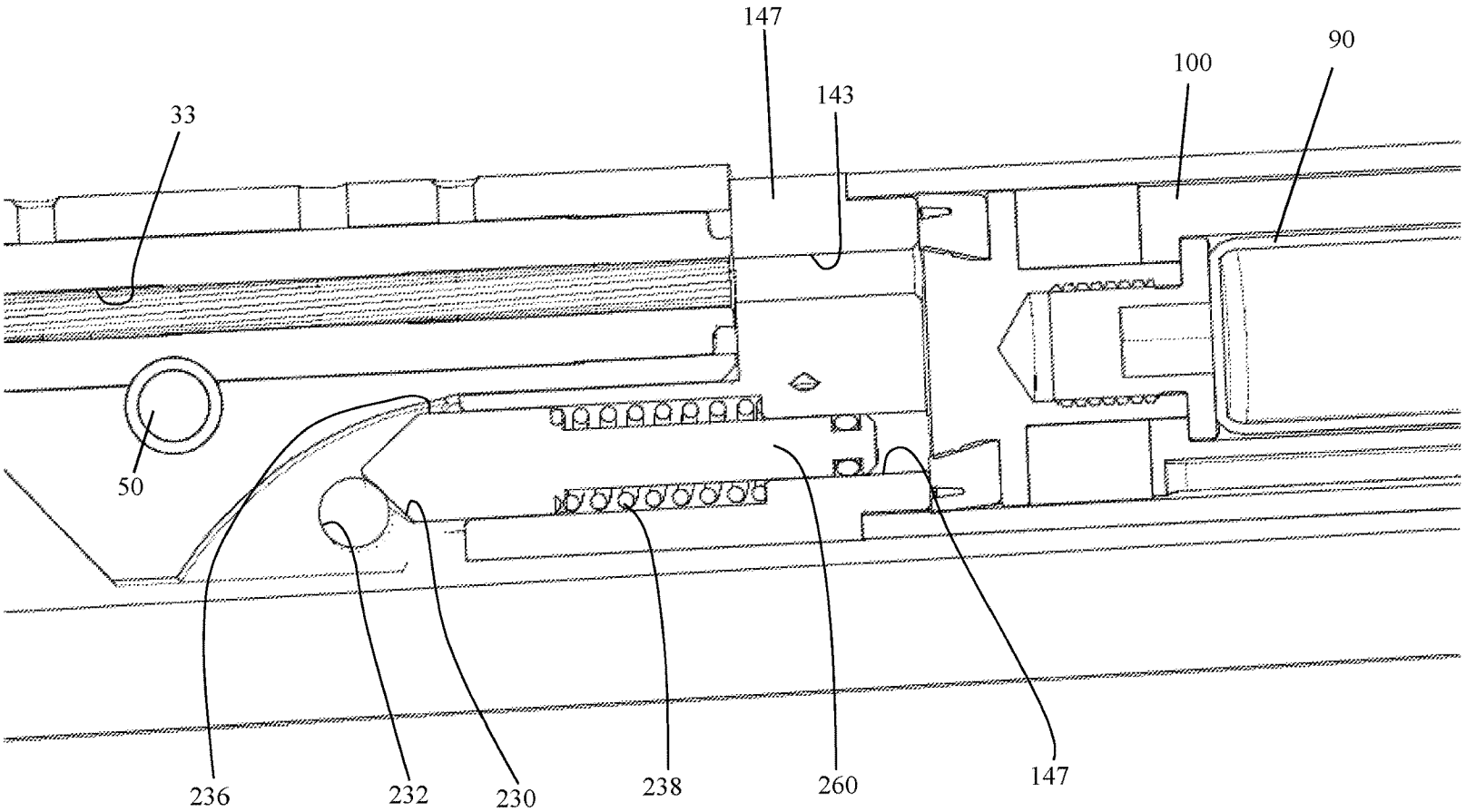
FIG. 16 is a cross sectional assembled view of a portion of the airgun of FIG. 14.
Figure 17:
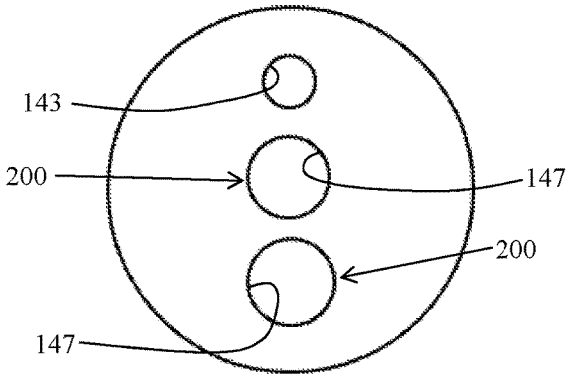
FIG. 17 is a schematic end view of a fork assembly of the airgun having a detent pin and a securing pin.
Figure 18:
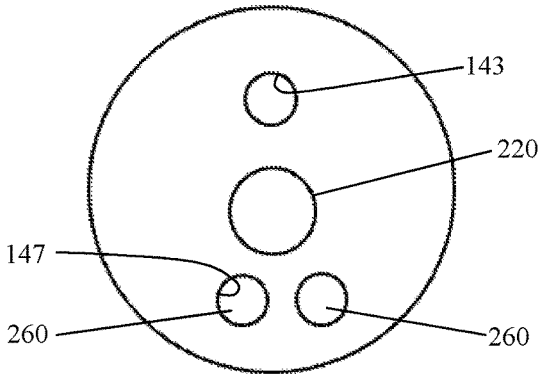
FIG. 18 is a schematic end view of a fork assembly of the airgun having a detent pin and a plurality of securing pins.
Figure 19:
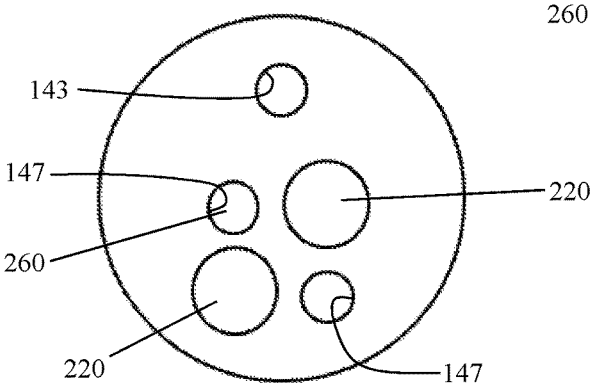
FIG. 19 is a schematic end view of a fork assembly of the airgun having a plurality of detent pins and a plurality of securing pins.

As seen in the Figures, the main body of the detent pin 220 can include a cavity 221 for receiving and engaging a portion of the plunger. Any of a variety of mechanisms can be used to cooperatively couple the main body 220 to the plunger 224 such as threads, press fits and bonding. Alternatively, the plunger 234 and the detent pin 220 are a single or integral body, particularly as seen in FIG. 16.

A washer 152 affixed to the fork 140 and can function as a shoulder or collar against which the bias spring 238 is disposed to act between the washer and the detent pin 220 urging the the detent pin to the firing (locking) position, and specifically, the inclined surface of the detent pin against the locking pin 232. To move the barrel assembly 20 and the receiver 60 from the firing position to the open or loading position, it is the force of the spring 238 urging the detent pin 220 to the firing position that must be overcome.

The plunger 224 of the detent pin 226 is moveable between a firing (or locking) position, furthest toward the muzzle 37, and an open or loading position nearer the pressure generator 80.

Although the detent pin 220 is shown employing the plunger 224, it is understood the plunger is not required as a separate element, but can be functionally incorporated or integrated into the detent pin or functionally accomplished through the detent pin itself.

The cocking mechanism 130 can be any of a variety of mechanisms including but not limited to cams or levers, including cocking arms and break barrel constructions. The cocking mechanism 130 allows the user to move the pressure generator 80, spring 90, from a fired configuration to a cocked configuration. Thus, energy is input into the airgun 10 for selective conversion into motion of the projectile through the barrel 30.

In operation, the motive gas is selectively passed from the pressure generator 80 to the barrel 30 in response to actuation of the trigger assembly 120, which transitions the pressure generator 80.

Specifically, during cocking of the airgun 10 (rotation of the barrel 30 relative to the receiver 60), the compression piston 100 moves against the spring 90 and the compression piston is locked in position by a sear. When the airgun 10 is fired, the compression piston 100 is pushed forward at high velocity by the spring 90 to compress the air in a chamber in the compression tube 110 ahead of the compression piston. This high pressure air is restricted so that it can flow out of the compression tube 110 through the motive gas passageway 143 against the pellet, which forces the pellet down the barrel and the locking gas passageway 147 which urges the active interlock 200, such as the detent pin 220 (either via the plunger 224 or directly on the integral structure of the detent pin) to the locking position and because of the offset from the longitudinal axis, creates a rotational moment urging the barrel 30 to the firing position with respect to the receiver 60.

That is, movement of the compression piston 100 from the cocked position to the fired position in response to the force of the spring 90 creates and forces pressurized gas (air) through the motive gas passageway 143 to the breech 35 to propel the projectile from the breech and through the barrel 30 as well as motive gas to pass through the locking gas passageway 147 to act on the active interlock 200 such as the detent pin 220 or the plunger 224 of the detent pin.

In one configuration, the generated high pressure air is exposed to the detent pin 220, and specifically the plunger 224. As the high pressure air acts on the plunger 224, and hence the detent pin 220, the detent pin is urged to the firing position, wherein the detent pin is further forced against the locking pin 232. As the inclined surface 222 of the detent pin 220 is forced against the locking pin 232, the locking pin, and hence breech block 40 and barrel assembly 20 and barrel 30 are urged in rotation about the pivot pin 50 to the firing position, thereby tending to lock or secure the barrel in the firing position and resisting the impulse forces generated by the motive gas being generated and exposed to the projectile.

Thus, the present design provides the active interlock 200 counteracts the forces generated during firing of a break barrel airgun 10, as a portion of the energy from the generated high pressure gas is used to create a force acting on the active interlock, such as the detent pin 220 to operably seat the detent pin as well as create a rotational force urging the barrel to the firing alignment—thereby providing for increased accuracy. The increased accuracy is derived from the rotational force urging the barrel 30 to the firing position counteracts the disruptive forces generated during firing and additional force seating the detent pin 220 to the firing position.

Although the active interlock 200 is shown as directly exposed to the pressure of the motive gas created by the pressure generator 80, it is understood pressure regulation can be employed by a pressure generator disposed between the pressure generator 80 and the active interlock, such as the detent pin 220 to control or regulate the pressure and hence force on the active interlock, detent pin, during firing. Similarly, the cross sectional area of the active interlock 200 (detent pin 220 or plunger 224) can be selected to provide a desired force on the active interlock, detent pin, corresponding to the designed pressures created by the pressure generator 80.

In a further configuration, the active interlock 200 can be provided by a securing pin 260 which is separate from the detent pin 220. In this configuration, the detent pin 220 is not exposed to the motive gas or the pressure generator 80.

Depending on the location of the pressure generator 80 in the barrel assembly or the receiver, the securing pin 260 can be slideably connected to either the barrel assembly 20 or the receiver 60. The securing pin 260 is separate from the detent pin 220 and is moveable between a firing/locking position and a retracted loading/cocking position, wherein a portion of the securing pin is received in a seating socket in the remaining one of the barrel assembly and the receiver in the firing/locking position.

The securing pin 260 is exposed to the motive gas or the pressure generator, such as the compression tube 110 or locking gas passageway 147, wherein the motive gas urges the securing pin to the locking position. It is understood that as with the detent pin 220 the locking gas port can intersect the motive gas passageway 143, rather than the compression tube 110.

For purposes of description, the securing pin 260 is set forth as slideably connected to the receiver 60. Specifically, the fork 140 can be modified to include the securing pin 260 in the locking gas passageway 147, wherein the detent pin 220 is spaced from the locking gas passageway and operates only under the influence of the bias spring 238, as known in the art.

It is contemplated the securing pin 260 can be connected to a locating spring for disposing the securing pin in a default position, such as the loading/cocking position. In this configuration, upon the trigger assembly 120 actuating the pressure generator 80 to expose the projectile to the pressurized gas, the securing pin 260 is also exposed to the pressurized (motive) gas. The force created by the pressurized gas acting on a cross sectional area of the securing pin 260 overcomes the force of the locating spring and disposes the securing pin to the locking position.

As with the detent pin 220, the cross sectional area of the securing pin 260 can be selected with respect to the available motive gas pressure to provide the corresponding force on the securing pin. Similarly, the securing pin 260 can include the operable surfaces described in connection with the detent pin and same interaction with the seating socket as the detent pin 220 with the capture socket 230. Also, as set forth above, the pressure from the pressure generator 80 can be regulated prior to acting on the active interlock 200, such as the securing pin 260, to provide a reproducible force from the securing pin.

The seating socket can include the locking pin as described with the detent pin, wherein the securing pin 260 can include the inclined surface 222 to contact the locking pin, thus imparting a rotation in the direction of aligning the barrel and the receiver. In addition, the locking pin and the securing pin 260 are located such that the engagement of the locking pin and the securing pin is spaced a second greater perpendicular distance from the longitudinal axis. In one configuration, the second distance is greater than the first distance and in a further configuration, the second distance is at least twice the first distance. In one configuration, the second distance is sufficiently greater than the first distance to create a lever arm that results in a rotational force about the pivot pin from the securing pin 260 engaging the locking pin that tends to engage a stop surface in the seating socket with the securing pin. That is, upon the securing pin 260 being urged into the seating socket and against the locking pin, a portion of this force acts on the lever arm (defined by the spaced pivot pin and locking pin) to create a moment urging the barrel assembly to the firing position.

Similarly, the seating socket can include the functional surfaces or guide pin, locking pins and seating surface as the capture socket.

Thus, a portion of the pressurized gas from the pressure generator 80 is used to lock the barrel assembly 20 (and barrel 30) relative to the receiver 60 during at least a portion of the firing cycle by exposing the portion of the pressurized gas to the active interlock 200 which is connected to one of the barrel and the receiver or pressure generator to move the active interlock to the locking position engaging with a remaining one of the barrel and the receiver or the pressure generator.

It is further contemplated that the active interlock 200, as either the detent pin 220 or the securing pin 260, can be carried by the receiver 60 and particularly the fork 140. That is, both the detent pin 220 and the securing pin 260 move to a locking/firing position to engage the barrel assembly 20, such as the capture socket or seating socket in the breech block 40. Alternatively, the detent pin 220 can be carried on the breech block 40 and the securing pin 260 carried on receiver 60, such as the fork 140. In a further configuration, the detent pin 220 can be carried on the receiver 60, such as the fork 140 and the securing pin 260 carried on breech block 40. It is further understood, both the detent pin 220 and the securing pin 260 can be carried on the breech block 40 to engage the receiver 60 in the locking/firing position.

It is further contemplated that both the detent pin 220 and the securing pin 260 can be exposed to the motive gas or the pressure generator 80, such as the compression tube 110, wherein the motive gas urges the pins to the respective locking/firing position. Alternatively, a plurality of securing pins 260 can be employed, wherein each of the securing pins is exposed to the motive gas or the pressure generator 80, such as the compression tube 110, wherein the motive gas urges the pins to the respective locking/firing position.

In yet another configuration of the active interlock 200 having a plurality of pins (either detent pin, securing pin, a plurality of detent or securing pins of a combination) exposed to the motive gas, the cross sectional area of the pins can be different so as to apply correspondingly different forces on the respective pin and hence locking force.

Thus, the present disclosure provides the airgun 10 with the barrel assembly 20; the receiver 60 pivotally connected to the barrel assembly between a firing position and open position; a pressure generator 80 selectively generating a volume of pressurized gas; and a detent pin assembly 220 moveable between (i) a retracted position allowing movement of the barrel assembly and the receiver from the firing position to the open position and (ii) an extended position upon the barrel assembly and the receiver being in the firing position, wherein the detent pin assembly is fluidly connected to the volume of pressurized gas which urges the detent pin assembly to the extended position.

It is contemplated the detent pin 220 can include the plunger 224, wherein the plunger being exposed to the volume of pressurized gas. Alternatively, the detent pin and the plunger can be a one piece construction. In one configuration, the detent pin 220 is moveably mounted to the receiver 60 and includes the plunger 224 and the spring 238, wherein the spring urges the detent pin to the extended position.

In a further configuration, the airgun 10 includes the barrel assembly 20 having the barrel 30 with the bore 33 extending along the longitudinal axis and the breech block 40 having the capture socket 230, the capture socket partly defined by the locking pin 232; the receiver 60 pivotally connected to the barrel assembly, the receiver including the pressure generator 80 having the spring 90 and the piston 100 for selectively generating a volume of pressurized gas; the detent pin 220 moveably connected to the receiver between the first retracted position and the second locking position, the detent pin engaging the seating surface and the locking pin in the locking position; and the plunger 224 connected to the detent pin and exposed to the volume of pressurized gas in the pressure generator, wherein the volume of pressurized gas in the pressure generator moves the plunger to urge the detent pin to the locking position.

It is also contemplated the airgun 10 can include the pressure generator 80 having the variable compression volume in which a volume of gas at an increased pressure is created; the detent pin 220 fluidly connected to the variable compression volume and moveable between the first retracted position and the second locking position, the detent pin engaging the seating surface and the locking pin 232 in the second locking position; and the barrel 30 pivotally mounted to the pressure generator, the barrel having the bore 33 fluidly connected, or exposed, to the variable compression volume, the barrel moveable between the open position and the firing position, wherein the bore is fluidly exposed to the variable compression volume.

A method is provided including firing the break barrel airgun 10 to expose a pressurized gas to a projectile in the bore 33 of the barrel 30; and exposing the portion of the pressurized gas to the active interlock 200 to urge the active interlock to the locking position inhibiting relative rotation of the receiver 60 and the barrel assembly 20 in the break barrel airgun.

The airgun can alternatively include the pressure generator 80 having a variable compression volume in which a volume of gas at an increased pressure is created; the active interlock 200 fluidly connected to the variable compression volume and moveable between the first retracted position and the second locking position; and the barrel 20 pivotally mounted to the pressure generator, the barrel having the bore 33 fluidly connected to the variable compression volume, the barrel moveable between the open position and the firing position, wherein the bore is fluidly exposed to the variable compression volume in the firing position.

It is understood the active interlock 200 can be a securing pin 260 or a detent pin 220. Further, the active interlock 200 can include both the securing pin 260 and the detent pin 220.

The invention has been described in detail with particular reference to a presently preferred embodiment, but it will be understood that variations and modifications can be effected within the spirit and scope of the invention. The presently disclosed embodiments are therefore considered in all respects to be illustrative and not restrictive. The scope of the invention is indicated by the appended claims, and all changes that come within the meaning and range of equivalents thereof are intended to be embraced therein.

The invention claimed is:

1. An airgun, comprising:

(a) a barrel assembly;

(b) a receiver pivotally connected to the barrel assembly between a firing position and open position;

(c) a pressure generator selectively providing a volume of pressurized gas; and (d) an active interlock moveable between (i) a retracted position allowing movement of the barrel assembly and the receiver from the firing position to the open position and (ii) an extended position upon the barrel assembly and the receiver being in the firing position preventing movement of the barrel assembly and the receiver from the firing position to the open position, wherein the active interlock is fluidly connected to the volume of pressurized gas to move the active interlock from the retracted position to the extended position.

2. The airgun of claim 1, wherein the active interlock is a detent pin moveably mounted to the receiver.

3. The airgun of claim 1, wherein the active interlock is a securing pin moveably mounted to one of the receiver and the barrel assembly.

4. The airgun of claim 3, further comprising a bias member urging the securing pin to the retracted position.

5. The airgun of claim 1, wherein the pressure generator includes a compression tube, a compression piston slideably received within the tube and a spring for selectively moving the compression piston relative to the compression tube.

6. The airgun of claim 1, further comprising a bias member, wherein the bias member urges the active interlock to the first retracted position.

7. The airgun of claim 1, wherein the barrel assembly includes a breech block defining a capture socket for receiving a portion of the active interlock in the extended position.

8. The airgun of claim 1, wherein the pressure generator is carried by the receiver.

9. The airgun of claim 1, wherein the pressure generator is carried by the barrel assembly.

* * * * *